US005695371A

United States Patent [19]

Katoh

[11] Patent Number: 5,695,371

[45] Date of Patent: Dec. 9, 1997

[54] CRADLE TYPE ENGINE MOUNT FOR WATERCRAFT

[75] Inventor: Naoki Katoh, Hamamatsu, Japan

[73] Assignee: Sanshin Kogyo Kabushiki Kaisha, Hamamatsu, Japan

[21] Appl. No.: 580,140

[22] Filed: Dec. 28, 1995

[30] Foreign Application Priority Data

Dec. 28, 1994 [JP] Japan ..... 6-327368

[51] Int. Cl.[6] ..... B63H 21/30

[52] U.S. Cl. ..... 440/111

[58] Field of Search ..... 440/111, 112; 248/637, 638, 659

[56] References Cited

U.S. PATENT DOCUMENTS

| | | | |
|---|---|---|---|
| 4,765,075 | 8/1988 | Nakase et al. | 440/111 |
| 4,778,421 | 10/1988 | Greenberg | 440/111 |
| 5,509,837 | 4/1996 | Allbright, Jr. et al. | 440/111 |

*Primary Examiner*—Stephen Avila

*Attorney, Agent, or Firm*—Knobbe, Martens, Olson & Bear LLP

[57] ABSTRACT

An engine mount for resilient mounting an internal combustion engine in a watercraft hull. The engine mount comprises a pair of cradle shaped members that are rigidly affixed to the front and rear underside of the engine and which are mounted at opposite sides of the engine on the hull by resilient cushions that permit resilient vertical movement of the engine relative to the hull.

13 Claims, 4 Drawing Sheets

CRADLE TYPE ENGINE MOUNT FOR WATERCRAFT

BACKGROUND OF THE INVENTION

This invention relates to a watercraft and more particularly to an improved engine mounting arrangement for a watercraft.

In a wide variety of types of watercraft, the watercraft is powered by a propulsion device that is driven by an internal combustion engine which is mounted within an engine compartment of the watercraft. Frequently, the hull is formed from a lightweight, relatively thin-gauge material such as a molded fiberglass reinforced plastic or the like. These materials provide good durability, high strength, and long life.

Frequently, the engine compartment is positioned toward the front of the hull and the engine output shaft is coupled to a propulsion device by a drive shaft that extends through an opening in the hull. The opening is frequently formed in a bulkhead formed at one end of the engine compartment.

As is well known, internal combustion engines are subject to a variety of types of vibration. Therefore, it is desirable to provide a resilient mount between the engine and the hull so that these vibrations will not be transmitted to the hull, amplified and then transmitted to the occupants of the watercraft. However, the optimum engine mounting location may not necessarily correspond to the areas of the hull where the hull configuration is the strongest and can accommodate the engine mount.

It is, therefore, an object of this invention to provide an improved arrangement for mounting an engine in a watercraft hull.

It is a further object of this invention to provide an improved cradle type mount for a watercraft engine.

SUMMARY OF THE INVENTION

This invention is adapted to be embodied in the watercraft that is comprised of a hull which defines an engine compartment. An internal combustion engine has a combustion chamber forming member which defines at least in part a combustion chamber. An engine output shaft is driven by the combustion in the combustion chamber and is journaled in an engine member. A cradle member spans the engine and is rigidly affixed to opposite sides of the engine. A pair of resilient spaced apart cushions support the cradle member and the engine in the engine compartment.

DETAILED DESCRIPTION OF THE PREFERRED EMBODIMENT OF THE INVENTION

Figure 1:
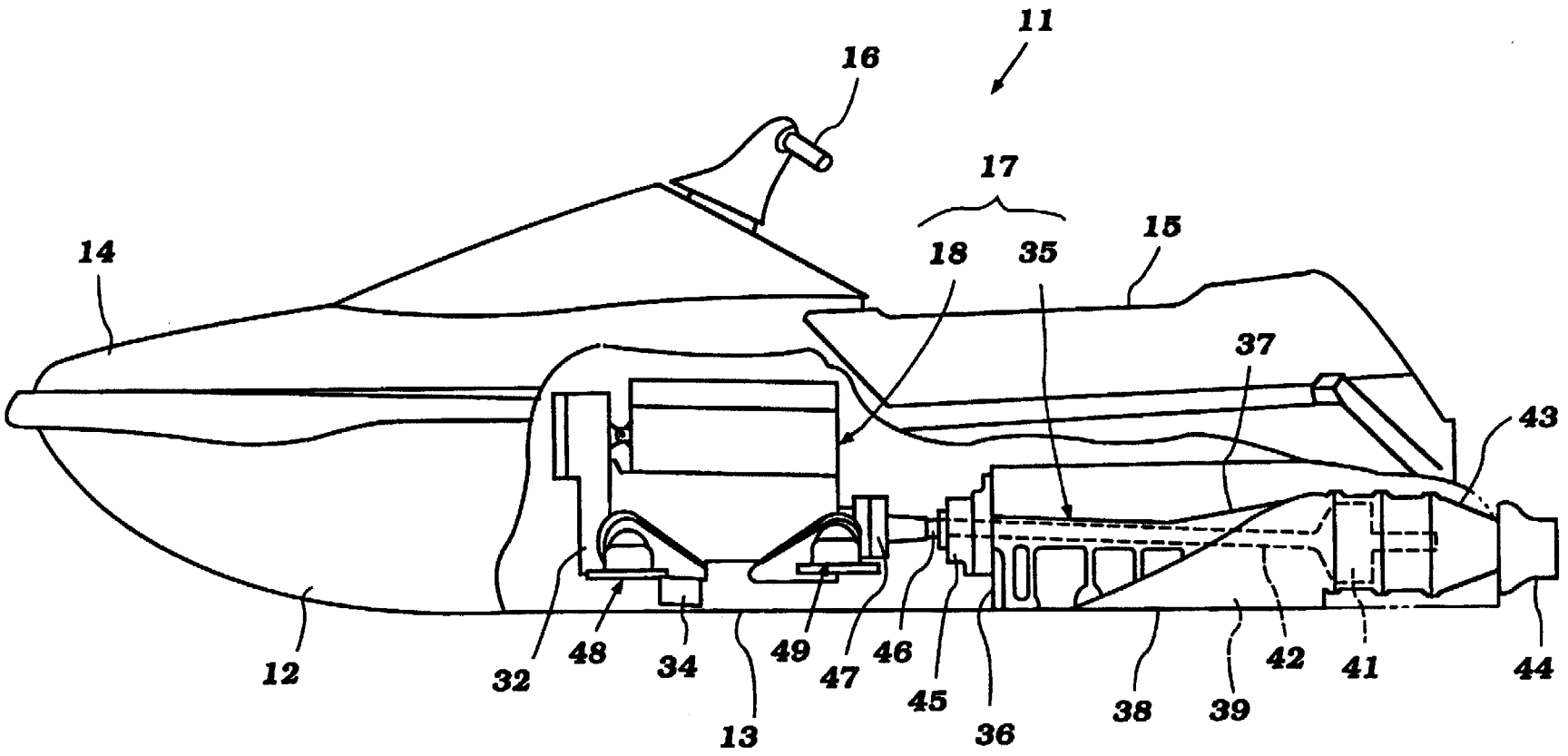
FIG. 1 is a side elevational view of a watercraft constructed in accordance with an embodiment of the invention, with portions broken away to more clearly show the engine and propulsion system.

Referring now in detail to the drawings and initially primarily to FIG. 1, a watercraft constructed in accordance with an embodiment of the invention is identified generally by the reference numeral 11. In the illustrated embodiment, the watercraft 11 is of the so-called "personal watercraft" type that is designed to be operated primarily by a single rider. Although the invention has particular utility in conjunction with such watercraft, it will be readily apparent to those skilled in the art how the invention may be practiced with a wide variety of other types of watercraft.

The watercraft 11 is comprised of a hull 12 having a lower hull portion 13 and an upper deck portion 14. The hull portions 13 and 14 are formed from a suitable material such as a molded fiberglass reinforced resinous plastic or the like. The hull portions 13 and 14 are fixed together around their peripheral edges in any known manner.

To the rear of the deck 14 there is provided a rider's area which is formed primarily by a raised pedestal-type longitudinally extending seat 15. A pair of foot areas are disposed on opposite sides of the seat 15 so as to accommodate the legs and feet of a rider or riders seated in straddle tandem fashion. A control mast 16 is provided at the forward portion of the seat 15 for operation by the forward-most seated rider. The handlebar assembly 16 is provided for steering of the watercraft 11 and other watercraft controls such as engine speed control in a suitable manner.

The watercraft 11 is propelled by a propulsion system, indicated generally by the reference numeral 17. This propulsion system includes an internal combustion engine 18 which is mounted in an engine compartment 19 formed forwardly of the seat 15 and which may extend at least partially beneath the seat 15.

Figure 2:
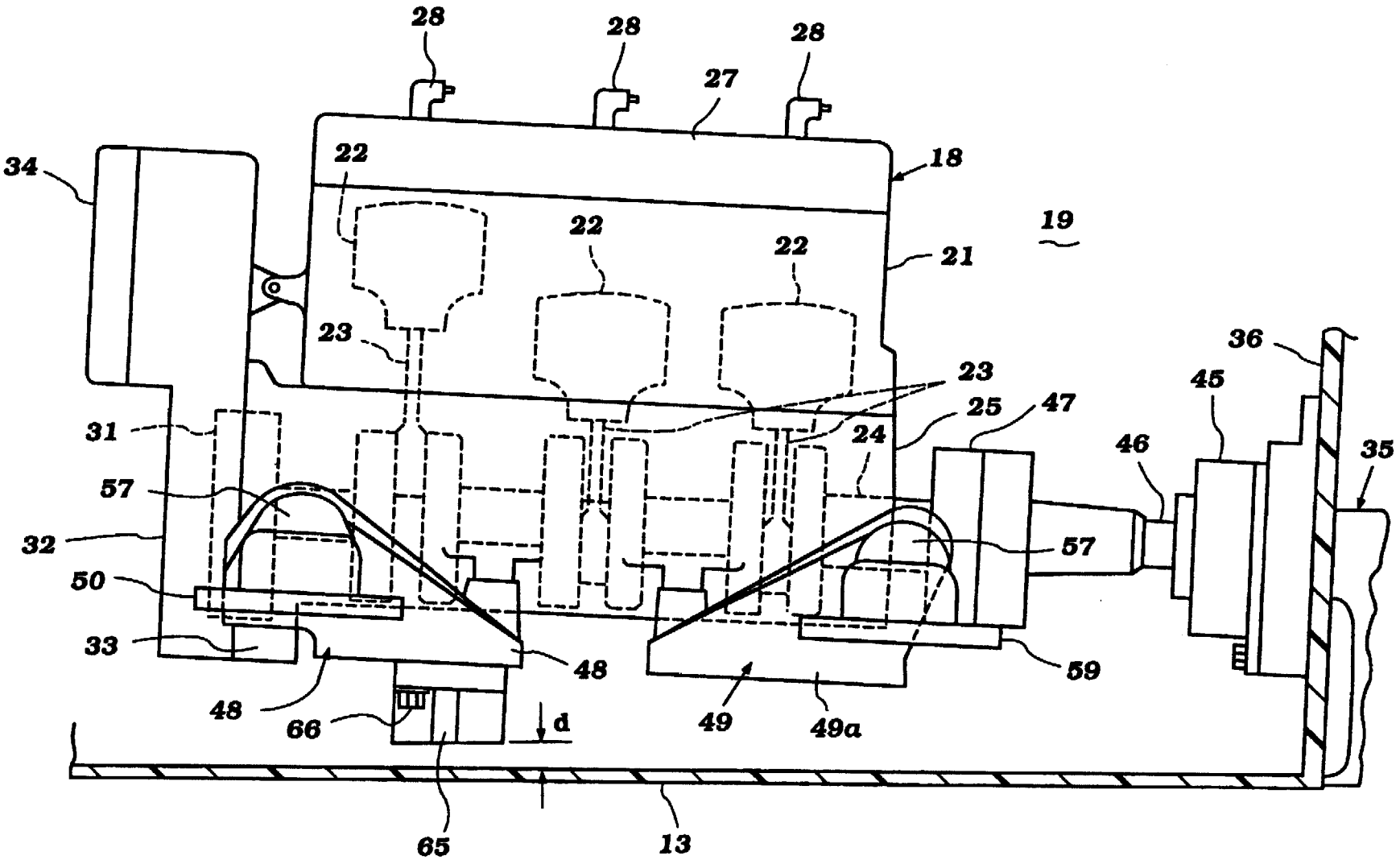
FIG. 2 is an enlarged cross-sectional view taken through the broken away portion of FIG. 1 and shows further details of the engine, propulsion system and the engine mount.
Figure 3:
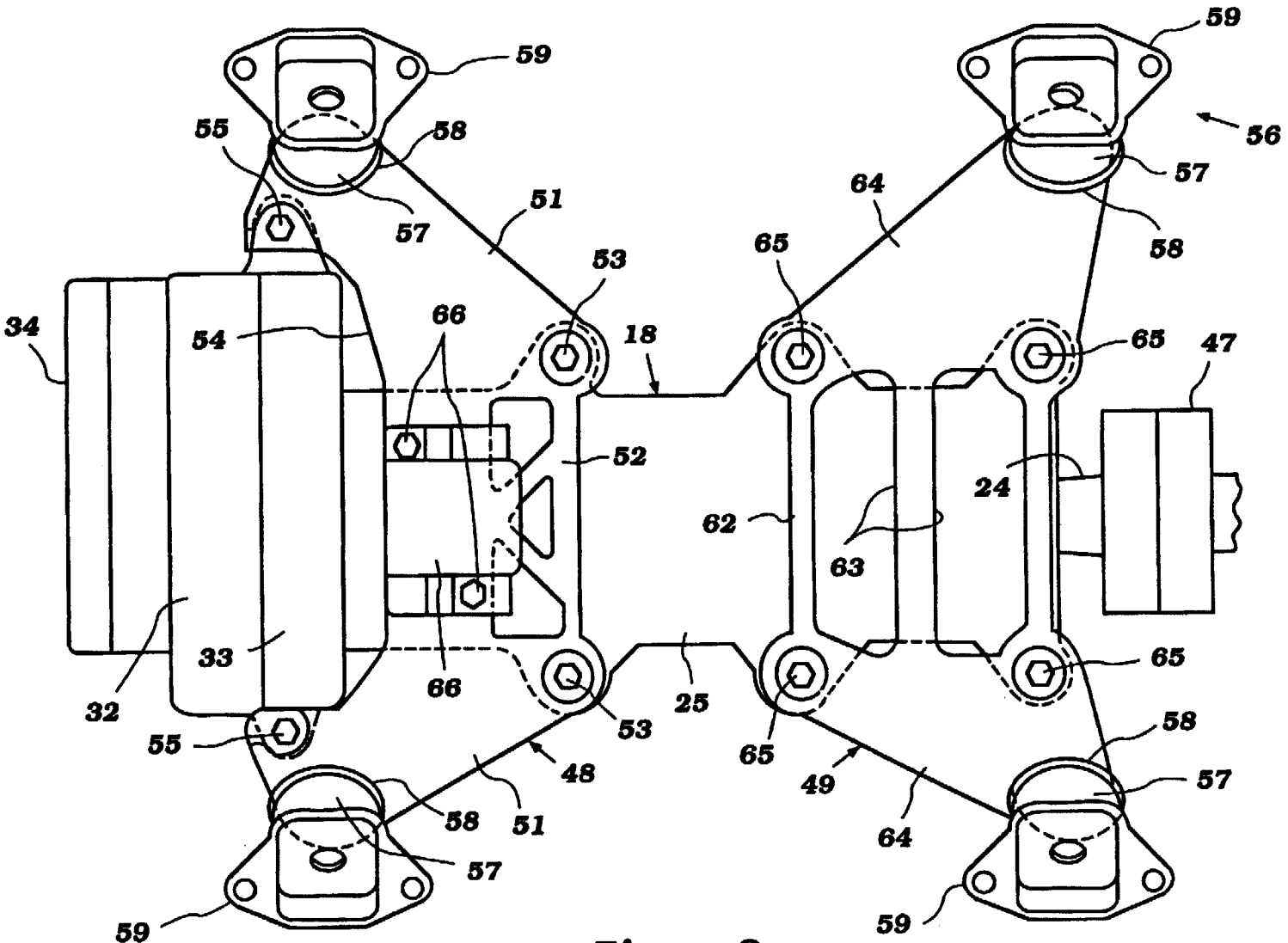
FIG. 3 is a bottom plan view of the engine mounting arrangement.

As may be best seen in FIG. 2, the engine 18 is of the three-cylinder, in-line type. To this end, the engine 18 is provided with a cylinder block 21 having three in-line cylinder bores formed in any suitable manner. Pistons 22 reciprocate in these cylinder bores. The pistons 22 are connected by means of connecting rods 23 to drive a crankshaft 24. The crankshaft 24 is rotatably journaled in a known manner, within a crankcase chamber formed by a crankcase member 25 that is affixed to the lower end of the cylinder block 21.

In the illustrated embodiment, the engine 18 operates on a two-stroke crankcase compression principle. It will be readily apparent to those skilled in the art, however, that the invention is not necessarily limited to engines operating on this principle. Also, although the invention is described in conjunction with a three-cylinder in-line type engine, it will also be readily apparent to those skilled in the art how the invention may be utilized in conjunction with other engine configurations.

Figure 4:
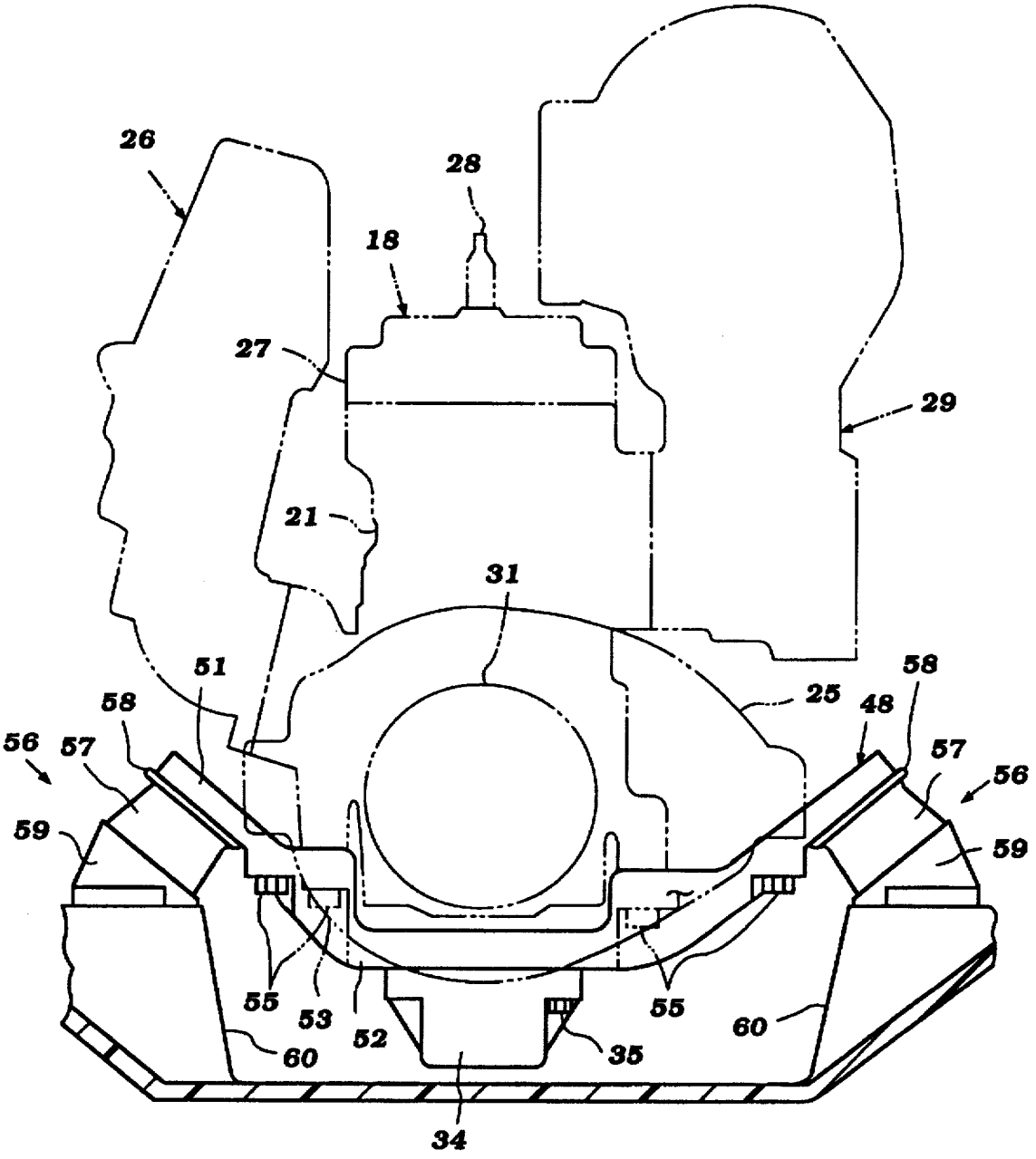
FIG. 4 is a cross-sectional view taken along the plane extending perpendicularly to the plane of FIGS. 1 and 2 and shows the engine in phantom.

As a two-cycle crankcase compression engine, the crankcase chamber in which the crankshaft 24 rotates is divided into a plurality of sealed chambers each associated with a respective one of the cylinder bores in which the pistons 22 reciprocate. An induction and charge-forming system, shown in phantom in FIG. 4 and identified generally by the reference numeral 26 is provided for supplying a fuel/air charge to these crankcase chambers. This charge flows into the crankcase chambers through reed-type check valves (not shown) which function to permit the in-flow of charge when the pistons 22 are moving upwardly but which preclude reverse flow as the pistons 22 move downwardly to compress the charge in the crankcase chambers.

This compressed charge is then transferred through one or more scavenge passages (not shown) to combustion chambers formed by the heads of the pistons 22, the cylinder bores, and a cylinder head member 27 that is affixed to the cylinder block 21 in any known manner. This charge is then fired by means of spark plugs 28 that are mounted in the cylinder head 27 and which are fired by an ignition circuit, in a manner to be described.

The burning charge expands and drives the pistons 22 downwardly so as to effect rotation of the crankshaft 24, as is will known in this art. The charge is then discharged through an exhaust system, shown schematically at 29 in FIG. 4. The exhaust system 29 is disposed on the opposite side of the cylinder block 21 from the induction system and conveys the exhaust gases to the atmosphere through any suitable path.

The internal details of the engine 18 have not been illustrated in any more detail and will not be described further because, for reasons already noted, the invention may be practiced with a wide variety of types and configurations of engines. The invention deals primarily with the mounting system for the engine 18 and that mounting system will be described later.

A flywheel 31 is affixed to the forward end of the crankshaft 24 and is journaled within a flywheel housing 32 which, is affixed to the cylinder block 21 and crankcase member 25 in any known manner and which may be formed in part by a forward extension 33 of the crankcase member 25. An ignition system is associated with the flywheel 31 and this may include a known type of flywheel magneto arrangement. The ignition system may be mounted in an extension 34 of the flywheel cover 32 and fires the spark plugs 28 in a known manner.

Referring again to FIG. 1, the propulsion unit 17 also includes a jet propulsion unit, indicated generally by the reference numeral 35 which is mounted to the rear of the hull 12 within a tunnel formed in part by a bulkhead 36 which defines the rearward extremity of the engine compartments 19.

The jet propulsion unit 35 is comprised of an outer housing 37 that defines a downwardly facing water inlet opening 38 which is aligned with or formed in part by an opening in the underside of the hull portion 12. The water inlet opening 38 delivers water through an inlet duct 39 to an impeller 41 under the action of the impeller 41. The impeller 41 is fixed to an impeller shaft 42 which is driven in a manner to be described.

Water pumped by the impeller 41 is discharged rearwardly through a discharge nozzle 43. A steering nozzle 44 is journaled for steering movement about a vertical axis on the discharge nozzle 43 in a known manner. The handlebar 16 is suitably connected to the steering nozzle 44 for steering of the watercraft 11 in a known manner.

The impeller shaft 42 extends forwardly through an opening in the bulkhead 36 where it is supported and sealed by a bearing assembly 45 fixed to the forward end of the bulkhead 36. There the impeller shaft 42 is coupled by a drive shaft 46 and flexible coupling 47 to the engine crankshaft 24.

The engine 18 is mounted in the hull 12 in accordance with the invention by a pair of cradle type engine mounts, indicated by the reference numerals 48 and 49. Each of these mounts is formed primarily from a high strength steel pressing or the like. The front mount 48 has a pair of wing like projections 51 that extend upwardly and outwardly from a central section 52. At the juncture between the sections 52 and 51 the section 52 is rigidly affixed to the crankcase member 25 by threaded fasteners 53.

The wing like portions 52 define an opening 54 which embraces the flywheel housing 32 and is are affixed thereto by threaded fasteners 55. In this area the cradle 48 is resiliently connected to the hull in a manner to be described by elastic isolators 56. These elastic isolators each comprise elastomeric blocks 57 which are bonded or vulcanized to plates 58 which are in turn suitably affixed to the wings 51 of the front cradle 48 on opposite sides of the engine.

At there opposite sides the elastic blocks 57 are bonded or vulcanized to mounting brackets 59. These mounting brackets 59 are, in turn, affixed to rigid pillars 60 formed in the hull portion 13.

Referring now to the rear cradle-type mount 49, it also is formed from a high-strength steel piece having a generally flat central portion 62 that is formed with lightning openings 63 and which terminates at its outer sides in a pair of wing-like portions 64 that extend upwardly from the central portion 62 at the outer peripheral edges thereof. At this juncture, threaded fasteners 65 provide a rigid attachment between the rear cradle member 49 and the crankcase member 25.

Resilient cushion mounts, indicated generally by the reference numeral 56 and having a configuration identical to that of the front mounts are interposed between the wing-like member 64 outer peripheral edges and further embossments 60 of the hull 13.

It should be readily apparent that the cradle-type engine mounts 48 and 49 may be easily affixed to the engine 18 before it is installed in the hull. The mounting then can be easily accomplished with the engine being hoisted in any suitable manner and then detachably connected through the cushioning mounts 56 to the hull.

The resilient cushions 56 will, of course, permit vertically movement of the engine 18 relative to the hull 13. It is desirable, however, to control or limit the degree of this vertical movement. Therefore, a rigid stopper plate 65 is mounted to the underside of the front cushion 48 by means of threaded fasteners 66. Under normal loading conditions, the stopper plate 65 is spaced at a distance d from the inner hull surface of the hull portion 13. This dimension d represents the total amount of downward movement of the engine 18 relative to the hull 12 that will be permitted by the resilient cushions 56. When the clearance d is taken up, the stopper plate 65 will contact the hull and will preclude any further resilient movement. Of course, if desired, a corresponding stop may also be provided between the cushions and the hull so as to limit the degree of vertical upward movement.

Of course, the foregoing description is that of a preferred embodiment of the invention and it will be readily apparent to those skilled in the art how variations may be made without departing from the spirit and scope of the invention, as defined by the appended claims.

What is claimed is:

1. A watercraft comprised of a hull defining an engine compartment, an internal combustion engine having a combustion chamber forming member defining at least in part a combustion chamber, an engine output shaft driven by combustion in said combustion chamber and journaled within an engine member, a unitary pressed sheet cradle member having a substantially uniform thickness and spanning said engine, said pressed sheet cradle member being comprised of a generally planar central portion and rigidly affixed thereto at at least three spaced locations on opposite sides of said engine and a pair of integral upwardly inclined, angled side portions spaced on opposite sides of said engine, and a pair of resilient spaced apart cushions connected to said cradle side portions for suspending said cradle member and said engine in said hull.

2. A watercraft as set forth in claim 1, wherein there are provided a pair of cradle members at the front and rear of the engine, respectively, and each being connected to the hull by a pair of resilient spaced apart cushions.

3. A watercraft as set forth in claim 1, wherein the resilient cushions permit resilient vertical movement of the engine relative to the hull.

4. A watercraft as set forth in claim 3, wherein the resilient cushions are disposed transversely outwardly of the sides of the engine.

5. A watercraft as set forth in claim 4, wherein there are provided a pair of cradle members at the front and rear of the engine, respectively, and each being connected to the hull by a pair of resilient spaced apart cushions.

6. A watercraft as set forth in claim 1, wherein the engine comprises a reciprocating engine and the combustion chamber forming member is comprised of a cylinder block and the engine member comprises a crankcase member and wherein the cradle-shaped member is rigidly affixed to the crankcase member.

7. A watercraft as set forth in claim 6, further including a flywheel affixed for rotation at one end of the engine output shaft.

8. A watercraft as set forth in claim 7, further including a propulsion device driven by the other end of the engine output shaft.

9. A watercraft as set forth in claim 8, wherein the propulsion device is driven by a drive shaft that extends through a bulkhead formed at one end of the engine compartment.

10. A watercraft as set forth in claim 9, wherein there are provided a pair of cradle members at the front and rear of the engine, respectively, and each being connected to the hull by a pair of resilient spaced apart cushions.

11. A watercraft as set forth in claim 9, wherein the resilient cushions permit resilient vertical movement of the engine relative to the hull.

12. A watercraft as set forth in claim 11, wherein the resilient cushions are disposed transversely outwardly of the sides of the engine.

13. A watercraft as set forth in claim 12, wherein there are provided a pair of cradle members at the front and rear of the engine, respectively, and each being connected to the hull by a pair of resilient spaced apart cushions.

* * * * *